US006799339B2

(12) United States Patent
Stewart

(10) Patent No.: US 6,799,339 B2
(45) Date of Patent: Oct. 5, 2004

(54) SLEEPING STRUCTURE

(75) Inventor: John Stewart, London (GB)

(73) Assignee: Worlds Apart Limited (GB)

( * ) Notice: Subject to any disclaimer, the term of this patent is extended or adjusted under 35 U.S.C. 154(b) by 0 days.

(21) Appl. No.: 10/060,329

(22) Filed: Feb. 1, 2002

(65) Prior Publication Data

US 2002/0104162 A1 Aug. 8, 2002

(30) Foreign Application Priority Data

Feb. 2, 2001 (GB) ..... 0102655

(51) Int. Cl.[7] ..... A47C 29/00

(52) U.S. Cl. ..... 5/413 AM; 5/413 R; 5/414; 5/417; 5/419; 5/420

(58) Field of Search ..... 5/413 AM, 413 R, 5/414, 417, 419, 420

(56) References Cited

U.S. PATENT DOCUMENTS

| | | | | | |
|---|---|---|---|---|---|
| 867,464 | A | * | 10/1907 | Abbott | 5/413 R |
| 1,324,009 | A | * | 12/1919 | Hope | 5/413 R |
| 1,648,373 | A | * | 11/1927 | Vilas | 5/413 R |
| 1,699,002 | A | | 1/1929 | Liebold | |
| 1,867,425 | A | | 7/1932 | Swetzel | |
| 2,015,588 | A | | 9/1935 | Brown | |
| 3,633,227 | A | * | 1/1972 | Tegeler | 5/413 R |
| 3,798,686 | A | | 3/1974 | Gaiser | |
| 3,818,962 | A | | 6/1974 | Muller-Scherak | |
| 3,840,919 | A | * | 10/1974 | Middleton | 5/413 AM |
| 3,860,980 | A | * | 1/1975 | Ebert | 5/413 R |
| 3,877,092 | A | | 4/1975 | Gaiser | |
| 3,958,274 | A | | 5/1976 | Klauber | |
| 4,087,874 | A | * | 5/1978 | Callaway et al. | 5/413 R |
| 4,091,482 | A | | 5/1978 | Malcolm | |
| 4,102,101 | A | | 7/1978 | Nielsen et al. | |
| 4,232,692 | A | * | 11/1980 | Atkins | 135/137 |
| 4,317,244 | A | | 3/1982 | Balfour-Richie | |
| 4,339,835 | A | | 7/1982 | Jaffe et al. | |
| 4,389,961 | A | | 6/1983 | Parish | |
| 4,531,330 | A | * | 7/1985 | Phillips | 52/2.21 |
| 4,575,884 | A | | 3/1986 | Jamerson et al. | |
| 4,604,765 | A | | 8/1986 | Schultz | |
| 4,605,029 | A | * | 8/1986 | Russell | 135/125 |
| 4,673,609 | A | | 6/1987 | Hill | |
| 4,757,832 | A | * | 7/1988 | Russell | 135/128 |

(List continued on next page.)

FOREIGN PATENT DOCUMENTS

| | | |
|---|---|---|
| BE | 511104 | 5/1952 |
| BE | 903360 | 2/1986 |
| DE | 2362215 | 12/1973 |

(List continued on next page.)

*Primary Examiner*—Teri Pham Luu
(74) *Attorney, Agent, or Firm*—Pillsbury Winthrop LLP

(57) ABSTRACT

The invention relates to a sleeping means which can be moved between the storage and in-use conditions. The sleeping means typically comprise a deformable mattress which is inflatable and which can be located within with an envelope formed of sheet material and, attached to the sheet material is a cover portion which, with the sheet material of the mattress define a sleeping area into which a person can move. The cover portion can be permanently attached to the sleeping means but further edges of the same can be selectively attached using zips or other fastening means. An additional portion of sheet material can be provided which can be selectively used to act as a storage pocket.

5 Claims, 9 Drawing Sheets

U.S. PATENT DOCUMENTS

| | | | | | |
|---|---|---|---|---|---|
| 4,774,734 | A | * | 10/1988 | Mills | 5/413 R |
| 4,856,131 | A | * | 8/1989 | Mills | 5/413 R |
| 4,862,533 | A | * | 9/1989 | Adams, III | 5/413 R |
| 4,896,387 | A | | 1/1990 | Malcolm et al. | |
| 4,996,733 | A | | 3/1991 | Tsai | |
| 5,005,235 | A | | 4/1991 | Huang | |
| 5,005,236 | A | | 4/1991 | Hutchinson | |
| 5,099,530 | A | | 3/1992 | Scott | |
| 5,172,440 | A | * | 12/1992 | Ming | 5/485 |
| 5,210,891 | A | | 5/1993 | Avital et al. | |
| 5,287,571 | A | | 2/1994 | Rademacher | |
| 5,303,435 | A | | 4/1994 | Haar et al. | |
| 5,392,477 | A | | 2/1995 | Wolter et al. | |
| 5,437,126 | A | | 8/1995 | Ramiro | |
| 5,471,687 | A | | 12/1995 | Vierra | |
| 5,528,779 | A | | 6/1996 | Lee et al. | |
| 5,553,339 | A | | 9/1996 | Thomas | |
| 5,560,056 | A | | 10/1996 | Tai | |
| 5,609,938 | A | | 3/1997 | Shields | |
| 5,640,725 | A | * | 6/1997 | Ando et al. | 5/413 AM |
| 5,660,197 | A | | 8/1997 | Boe et al. | |
| 5,669,088 | A | * | 9/1997 | McNamee | 5/413 AM |
| 5,669,092 | A | | 9/1997 | Lin | |
| 5,740,565 | A | * | 4/1998 | McDade | 5/413 AM |
| 5,773,110 | A | | 6/1998 | Shields | |
| 5,785,219 | A | | 7/1998 | Kraft | |
| 5,830,529 | A | | 11/1998 | Ross | |
| 5,858,155 | A | | 1/1999 | Hill et al. | |
| 5,864,908 | A | | 2/1999 | Kielman | |
| 5,881,405 | A | | 3/1999 | Garrigues | |
| 5,966,756 | A | | 10/1999 | Cartier | |
| D420,780 | S | | 2/2000 | Cox et al. | |
| 6,190,486 | B1 | | 2/2001 | Switlik | |
| 6,223,367 | B1 | * | 5/2001 | French et al. | 5/419 |
| 6,243,892 | B1 | | 6/2001 | Kelling | |
| 6,321,400 | B1 | | 11/2001 | Gulino | |
| 6,367,083 | B1 | * | 4/2002 | November | 2/69.5 |
| D458,730 | S | | 6/2002 | Jeong | |
| 6,421,852 | B1 | * | 7/2002 | Shao | 5/413 R |
| 6,463,604 | B1 | | 10/2002 | Reveron et al. | |
| 6,478,038 | B1 | * | 11/2002 | Le Gette et al. | 135/96 |
| 6,539,565 | B1 | | 4/2003 | Trimble | |
| 6,543,072 | B2 | | 4/2003 | Hsu | |
| 6,568,012 | B2 | | 5/2003 | Michaelis et al. | |
| 6,588,036 | B1 | | 7/2003 | Hort | |
| 6,598,248 | B1 | | 7/2003 | Ong | |
| 6,675,414 | B2 | | 1/2004 | Lamke | |
| 2002/0078501 | A1 | | 6/2002 | Lamke | |
| 2002/0083525 | A1 | | 7/2002 | Zheng | |
| 2002/0100120 | A1 | | 8/2002 | Hsu | |
| 2002/0133879 | A1 | | 9/2002 | Smith et al. | |
| 2003/0019037 | A1 | | 1/2003 | Michaelis et al. | |
| 2003/0028972 | A1 | | 2/2003 | Michaleis et al. | |
| 2003/0168093 | A1 | | 9/2003 | Zheng | |
| 2003/0204908 | A1 | | 11/2003 | Figler | |
| 2004/0025929 | A1 | | 2/2004 | Turner | |

FOREIGN PATENT DOCUMENTS

| | | | |
|---|---|---|---|
| DE | 3135647 | A1 | 3/1983 |
| DE | 8811253.5 | | 9/1988 |
| DE | 4437633 | A1 | 10/1994 |
| DE | 19830452 | A1 | 7/1998 |
| DE | 20015180 | U1 | 2/2001 |
| EP | 0086336 | A2 | 1/1983 |
| EP | 0748475 | B1 | 11/1994 |
| EP | 0976349 | A2 | 7/1999 |
| EP | 1342868 | A1 | 10/2003 |
| FR | 2305154 | | 11/1976 |
| FR | 2671274 | A1 | 4/1991 |
| FR | 2682270 | A1 | 5/1992 |
| FR | 2713902 | A1 | 12/1993 |
| GB | 648452 | | 1/1948 |
| GB | 702513 | | 5/1952 |
| GB | 821966 | | 10/1959 |
| GB | 979852 | | 1/1965 |
| GB | 2118096 | A | 2/1983 |
| GB | 2138048 | A | 10/1984 |
| GB | 2165292 | A | 4/1986 |
| GB | 2166343 | A | 5/1986 |
| GB | 2174383 | A | 11/1986 |
| GB | 2177292 | A | 1/1987 |
| GB | 2185681 | A | 7/1987 |
| GB | 2188873 | A | 10/1987 |
| GB | 22905959 | A | 1/1996 |
| IT | 564949 | | 11/1956 |
| JP | 5333723 | | 3/1978 |
| JP | 8-24104 | | 1/1996 |
| WO | WO94/17266 | | 8/1994 |
| WO | WO95/31170 | | 11/1995 |
| WO | WO 97/15433 | | 5/1997 |
| WO | WO 97/15453 | | 5/1997 |
| WO | WO 97/25213 | | 7/1997 |
| WO | WO 97/47481 | | 12/1997 |
| WO | WO 98/17480 | | 4/1998 |
| WO | WO 98/43832 | | 10/1998 |

* cited by examiner

SLEEPING STRUCTURE

SLEEPING MEANS

The invention of this application relates to sleeping means for use in providing a comfortable, portable, sleeping location for a person. In particular, although not necessarily exclusively, the apparatus can be used in camping, or in other locations where a person may temporarily wish to sleep, perhaps if they are visiting other persons who do not have sufficient beds for use by them or for use by a child who is sleeping over at a friend's house. It should therefore be appreciated that the sleeping means can be used in many different environments and can be adopted to different designs to suit the particular environment.

For temporary sleeping accommodation, the use of sleeping bags, which typically comprise an envelope of material which has free ends along one side which can be zipped or otherwise joined together to allow the person to move into and get out of the envelope, is well known. When the envelope is zipped the person is kept warm. A problem with the sleeping bag however is that while the same may provide the warmth required by the user, if the user is lying on a floor, or an uneven surface, they can be relatively uncomfortable due to the relative hardness and/or unevenness of the surface.

It is also known for people to sleep on an inflatable mattress, with bedding placed on top of the mattress such as sheets, duvets and the like. This can provide added comfort but what typically happens during use is that the bedding moves with respect to the inflatable mattress and this can allow the person to come into direct contact with the plastic mattress material which can be uncomfortable and/or unpleasant for the person, often causing them to wake up. Alternatively, the person can slip off the mattress during sleep. This is a particular problem with children and can make the same unattractive to the child.

The aim of the present invention is to provide a sleeping means which allows comfort and warmth to be obtained for the person using the same and for the same to be maintained throughout the night as the person sleep. It is a further aim to allow the sleeping means to be portable and easily stored when not in use. It is a yet further aim to provide added utility to the sleeping means such that other facilities can be provided to the user hence adapting the sleeping means to suit particular requirements and uses such as for example, children's sleepover parties, outdoor camping and the like.

In a first aspect of the invention there is provided sleeping means comprising a sheet material envelope having an opening into a cavity defined therein for the reception of, and substantial enclosure therein, of a deformable mattress characterised in that the sleeping means further includes a cover section which, in conjunction with the top surface of the envelope, defines a sleeping area in which a person can lie and be supported by the mattress and the cover portion is movable between a first position to substantially enclose the person within the sleeping area and a second position to allow the person to get into or out of the sleeping area of the sleeping means, Typically therefore the sleeping means has an opening transversely to the length of the sleeping means into a cavity defined by the sheet material envelope for the reception and substantial enclosure therein of the mattress which is typically an inflatable mattress. The mattress is typically inserted into the cavity in a deflated condition whereupon, the same can then be inflated as required for use.

In a preferred embodiment, at least one edge of the cover portion is integrally attached to the sheet material which defines the cavity for the mattress. Typically a further portion of the cover is selectively engageable with the sheet material envelope by any of stud fastenings, loop and hook fastenings, zips or other suitable releasable fastening means so as to allow the cover to be retained in the first position.

In a preferred embodiment the deformable mattress is an inflatable mattress.

Typically when the cover portion is placed over the person in the sleeping area and the potion of the same is selectively engaged in the fist position, only one edge remains free from the sheet material envelope said edge being that most closely located to the head end of the sleeping means.

In one embodiment, when sleeping means includes a pillow receiving section which can receive either a pillow which is separate to the mattress or, preferably, a pillow which is formed by a formed part of the inflatable mattress.

In one embodiment, when the sleeping means is not in use, the separate pillow can be removed from the pillow receiving section of the mattress can be deflated so as not to fill the pillow receiving section, and said pillow receiving section vacate the is used as a storage means such that the mattress and the remaining sheet material are moved, typically by rolling up the same, and placed into the pillow receiving section where it is material for storage. In one embodiment the pillow receiving section can be shaped so as to depict a well known character, or animal or other shape. Preferably said character, animal or shape, or material linked to the same, is also depicted at another location on the sleeping means, typically on the cover portion. This embodiment is particularly attractive to the sleeping means for use by children when cartoon or other well known children's characters can be depicted.

In one embodiment, the cover portion includes filling and/or insulating material to add warmth. For example the cover can be provided in the form of a duvet or other warmth giving configuration so as to improve the warmth and comfort to the person in the sleeping area.

The fabric used for the sheet material can be any suitable fabric of a type for a person sleeping.

In a further embodiment of the invention an additional portion of sheet material is provided, said portion typically having at least one edge permanently fixed to the sleeping means and some of the remaining parts selectively engageable with the sheet material. Said additional portion when selectively engaged, forms a storage pocket into which the remainder of the sleeping means comprising the sheet material and mattress can be inserted and stored. In one preferred embodiment the additional potion is attached to the underside of the sleeping means such that when the sleeping means is in use it is not normally viewable. Preferably the surface of the additional portion which faces the sheet material of the sleeping means when the sleeping means is in use becomes an outer surface of the sleeping means when moved to a storage condition. Preferably said surface includes an image applied thereto.

Preferably handles are provided such that when the sleeping means is stored, the same can be transported.

Typically the said additional portion is selectively engaged to the sheet material via a zip fastener. Typically the additional portion is selectively engaged once the sheet material and mattress has been moved to the storage position.

In a further embodiment of the invention an inflatable surround is provided around part of all of the sheet material so as to prevent the person sleeping in the same moving of falling off the inflatable mattress and/or to allow further facilities to be provided such as cup holders, book holders, and the like.

In a yet further embodiment of the invention the sleeping means includes an enclosure structure which covers a portion of the sleeping means.

The enclosure typically incorporates a frame over which sheet material can be placed and acts to support and form the enclosure. In one embodiment the enclosure is used as an insect shield to minimise interference from those insects in the environment where the sleeping means is being used.

In one embodiment the frame is formed of a series of inflatable members which can be integral with or separate to the inflatable mattress.

In a further embodiment the frame is, formed of a resilient member or members which are biased to an erected condition so as to allow the same to move between a coiled, storage condition and an extended erected condition.

Preferably the resilient members(s) moves to the extended position automatically upon release and remains in that position until physically coiled.

In a preferred embodiment the inflatable mattress is wholly inflated and deflated via a single valve inlet/outlet. Typically the valve has a diameter of more than 15 mm to ensure rapid inflation or deflation of the inflatable mattress.

A specific embodiment of the invention is now described with reference to the accompanying drawings, wherein.

Figure 9:
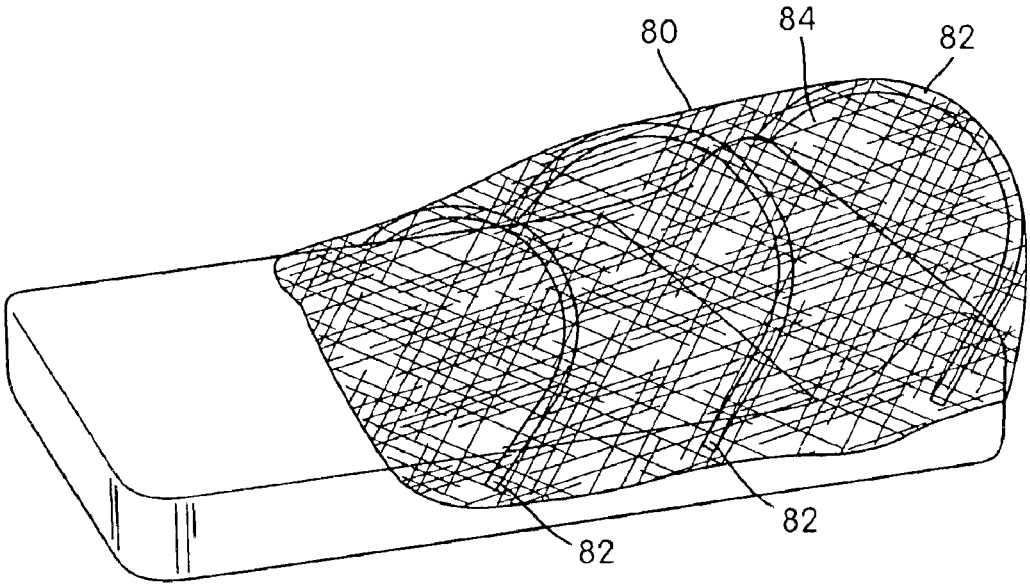

FIGS. 8A–E illustrate the movement of a sleeping means in accordance with the invention between in use and storage conditions in a further embodiment;

FIG. 9 illustrates a sleeping means with enclosure in accordance with a further embodiment of the invention.

Figure 1:
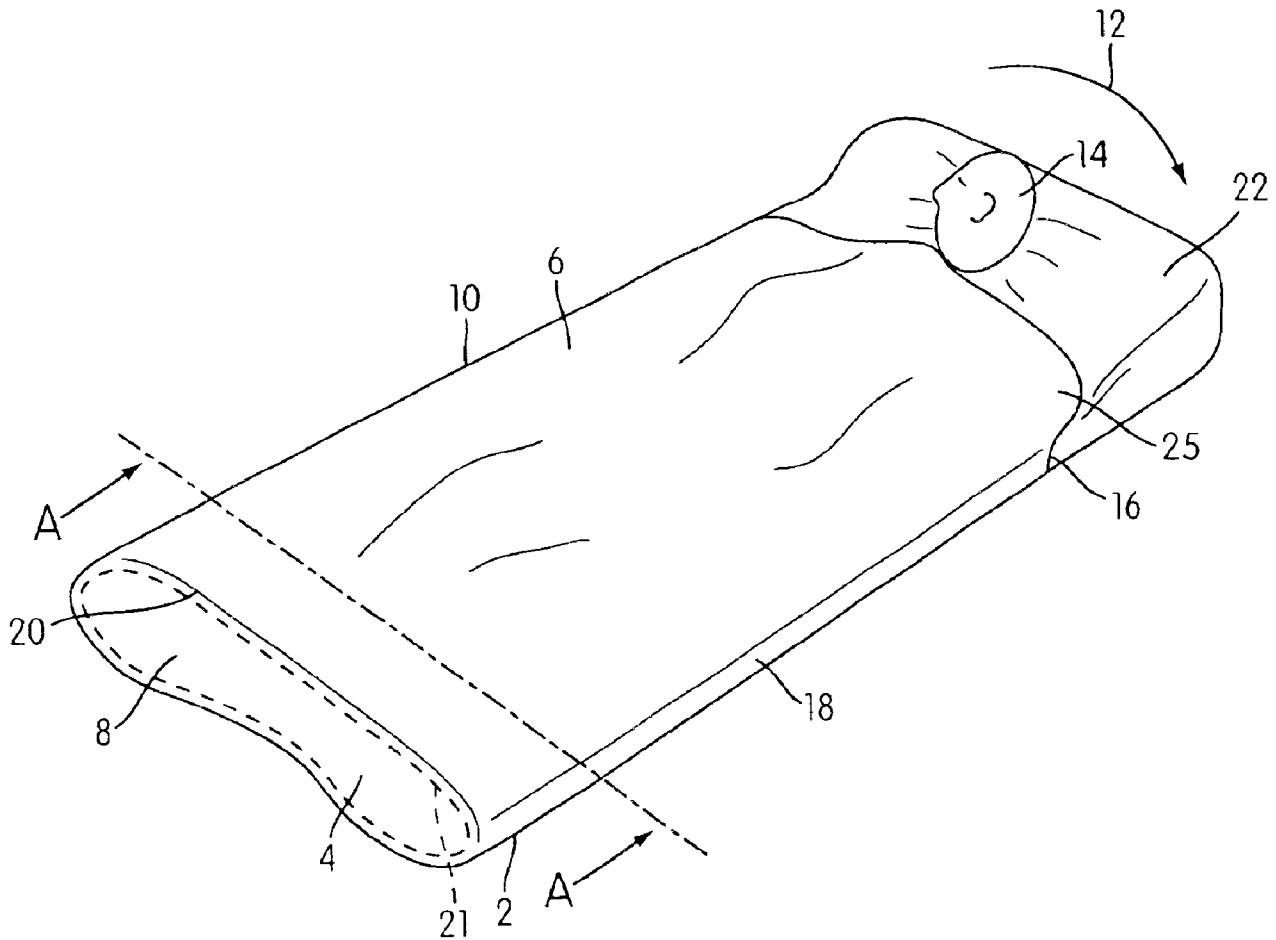
FIG. 1 illustrates a perspective view of the sleeping means in use in accordance with the invention.
Figure 2A:
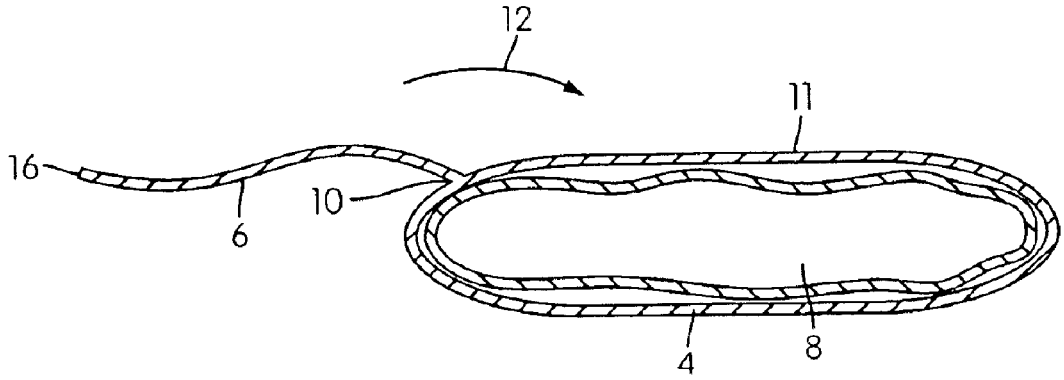
FIGS. 2A and 2B illustrate sectional and views of the sleeping apparatus in second and first conditions respectively, in one embodiment.
Figure 2B:
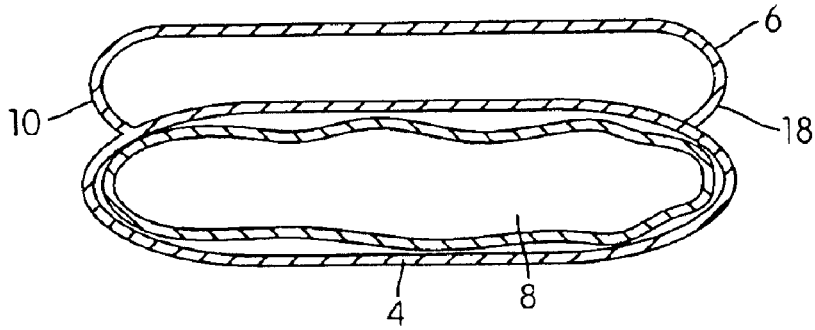

Referring firstly to FIGS. 1, 2A and 2B there is illustrated a sleeping means in accordance with a first embodiment of the invention, said apparatus comprising sheet material 2 which forms an envelope with a cavity 4 and a cover portion 6. The cavity 4 is used to receive an inflatable mattress B therein as indicated by broken lines, which extends the length of the cavity and hence the sleeping means.

The cover portion 6 is attached at one edge 10 to the sheet material envelope and together with the top sheet 11 of the envelope 4 defines a sleeping area 5. The free end 16 of the cover portion can be moved as indicated by arrow 12 once a person 14 is in the sleeping area so as to cover themselves as shown. The free edge 16 of the cover can be selectively attached to the edge 18 of the cavity sheet material as shown, in FIG. 2B by zip, hook and loop fastening or other fastening means. The foot end edge 20 of the cover portion may also be attached to the bottom edge 21 of the cavity sheet material 4 thus enclosing the person 14 in the sleeping means with the exception of the aperture 25 at the head end of the sleeping means.

A pillow receiving portion 22 is provided over which the cover 6 does not pass and this portion 22 is formed so as to be higher than the remainder of the mattress to allow the insertion of a pillow or alternatively and preferably, to allow the expansion of the inflatable mattress to form a higher pillow portion 27.

FIGS. 2A and 2B illustrate a cross section along line A—A of FIG. 1 and show the sleeping means with the cover portion in a first, closed, condition in FIG. 2B and a second, open, condition in FIG. 2A. In FIG. 2A there is shown the cavity 4 with the inflatable mattress 8 in an inflated condition. In this case, the cover 6 is shown in an open position as the person has not yet entered the sleeping area and the cover portion is attached to the sheet material envelope along the edge 10.

Figure 2C:
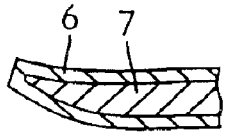
FIG. 2C is a partial cross-sectional view of an embodiment of a cover portion of the sleeping means.

FIG. 2B illustrates the same sleeping means but in this case, the cover portion 6 is in the closed position to enclose a person who wishes to go to sleep in the sleeping area with the cover portion placed over the person to keep the person warm. It is envisaged that it will be particularly preferable for the cover portion 6 to be formed to include or receive some form of warmth giving material such as filling material 7 (see FIG. 2C) so that the cover 6 is effectively a duvet, quilt or the like. In many instances, it may be preferred for all of the sheet material to be provided with pockets to receive warmth giving materials such as feathers etc. to be selectively placed therein and thereby allow the sleeping means to be adapted for use in different environmental conditions and/or to suit personal preferences. Furthermore the layer of material 11 between the mattress and the person in the sleeping area can be padded to make the sleeping in the same more comfortable.

Figure 3:
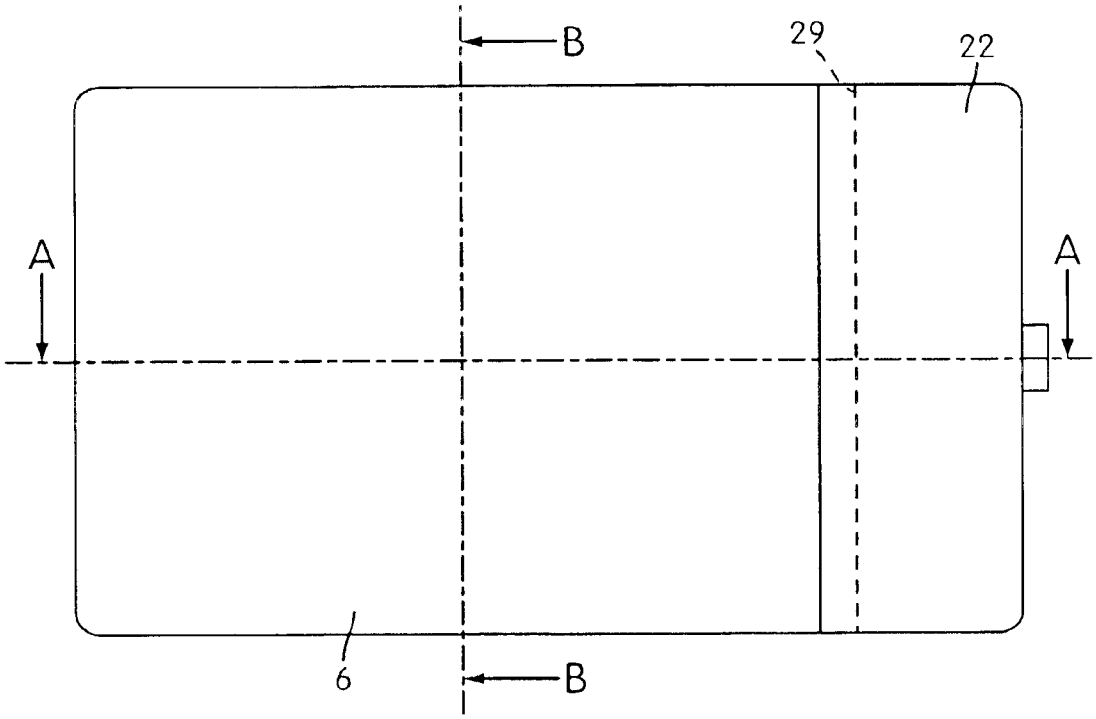
FIG. 3 illustrates a sleeping means according to one embodiment of the invention in plan.
Figure 4A:
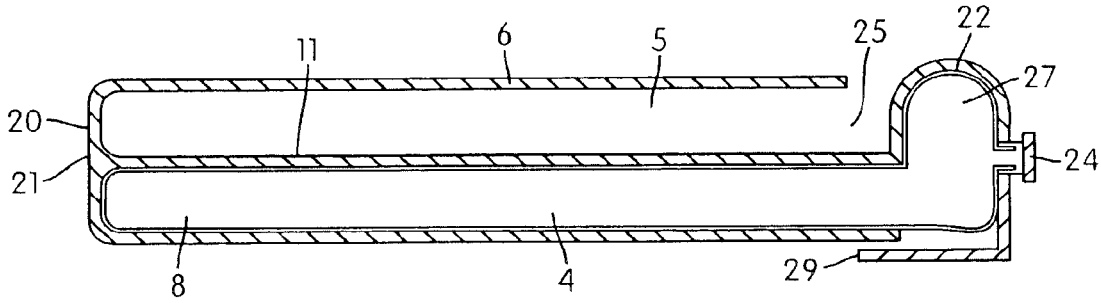
FIGS. 4A and 4B illustrate sectional views of the sleeping means of FIG. 3 along lines A—A and B—B respectively.
Figure 4B:
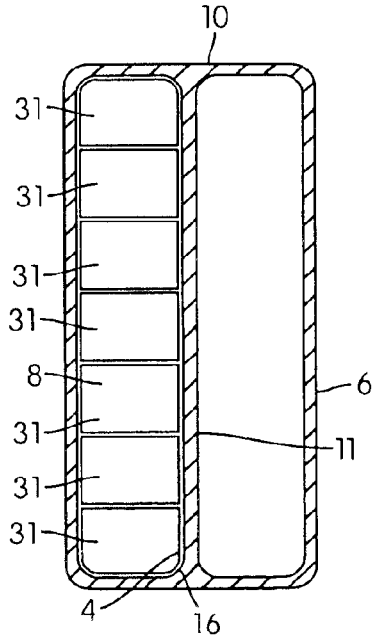

A further embodiment of the sleeping means is illustrated with respect to FIGS. 3, 4A and 4B, using the same reference numbers. In this embodiment the mattress 8 is shown in an inflated condition and includes the pillow portion 27 which fills the pillow receiving portion 22 of the sheet material to form a pillow for the use of the sleeping means.

Thus, in use, the mattress is provided in a deflated condition whereupon the same is inserted into the cavity through an opening 29 and moved along the length of the cavity. Although the mattress can then be removed in a deflated state for washing and the like, it is envisaged that the mattress will normally remain in the cavity, moving between deflated and inflated conditions as required. In an alternative embodiment, not shown, the inflatable mattress may in fact be provided integrally within the envelope so that the same does not need to be inserted into the envelope.

In whichever embodiment, a single valve inlet/outlet 24 provided for the inflation and deflation of the mattress 8. In the embodiments shown the valve is provided at the head end adjacent the pillow. With this invention, the valve and inflation system is designed to allow for full inflation from one inflation valve and by maximising the size of the aperture so quick inflation and deflation of the mattress can be achieved.

Accordingly, in one embodiment, the internal construction of the inflatable bed is such that there is full communication between all internal sections 31 as shown in FIG. 4B, and also with the integral pillow section 27 and the rest of the mattress. The valve preferably has a large entrance diameter, in excess of 15 mm and most probably around 25 mm. Whilst allowing for swift inflation, either with a manual pump or an electric pump, it also allows for swift deflation, as all the chambers deflate through this large exit orifice. Typically when deflating the sheet material and mattress are rolled as one towards the opened valve 24 thus allowing the collapsing of the entire bed in seconds.

With the inflatable mattress retained in the cavity defined by the sheet material when stored the subsequent reuse of the sleeping means becomes much simpler thereafter.

Alternatively, the mattress cam of course be simply inserted into the cavity in a deflated or inflated state every time it is required to be used.

The sleeping means as described therefore allows the person to be fully enclosed within the sleeping area of the sleeping means and, importantly, ensures that even when sleeping and moving around in their sleep, the person will not be able to come into direct contact with the inflatable mattress equally, the inflatable mattress will always stay with the bedding material.

Figure 5:
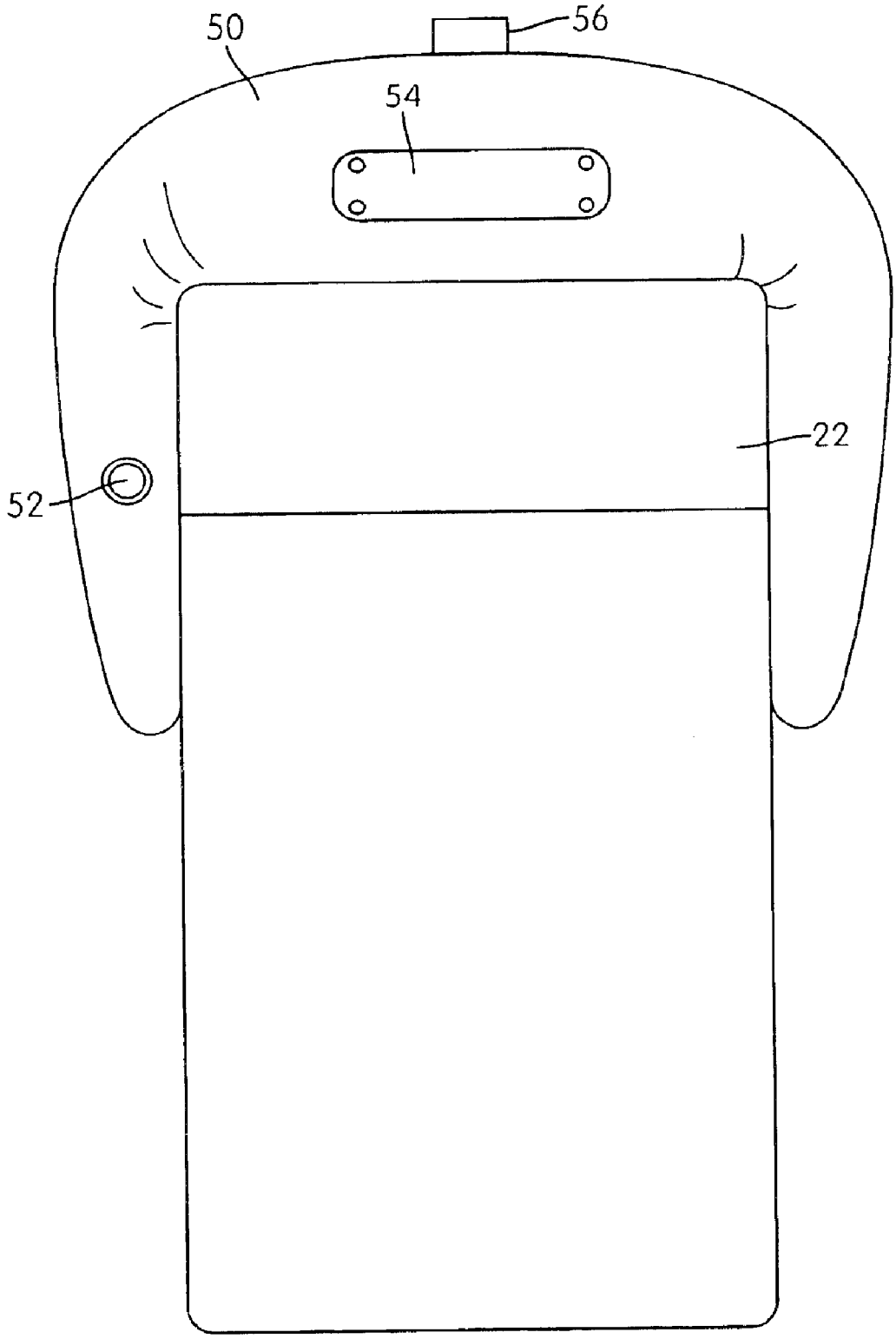
FIG. 5 illustrates a further embodiment of the sleeping means.

FIG. 5 illustrates a further feature of the invention whereby in addition to the sleeping means sheet material and mattress, a surround 50 is provided around the head portion of the sleeping means. This surround has two uses, a first being that it provides support for the persons head should it fall off the raised pillow potion during sleep. Secondly the surround can provide other functions such as a drinks holder cavity 52, book holder 54 and the like. These further functions can be used when the person is lying down or alternatively the person can move to a sitting position using the pillow potion and the surround 50 as a back support and then use the functions as and when required.

In one embodiment the surround is inflatable along with the mattress by the provision of interconnecting ports and via valve 56 or alternatively the surround can be in additional feature which may be selectively attached to the sleeping means by the user.

In one preferred embodiment it is possible to alter the shape of the bed by either changing the shape of the mattress itself (e.g. by having a rounded end, rather than a square end) or by adding 3 dimensional elements 58 to the sheet material that surrounds it.

Figure 6:
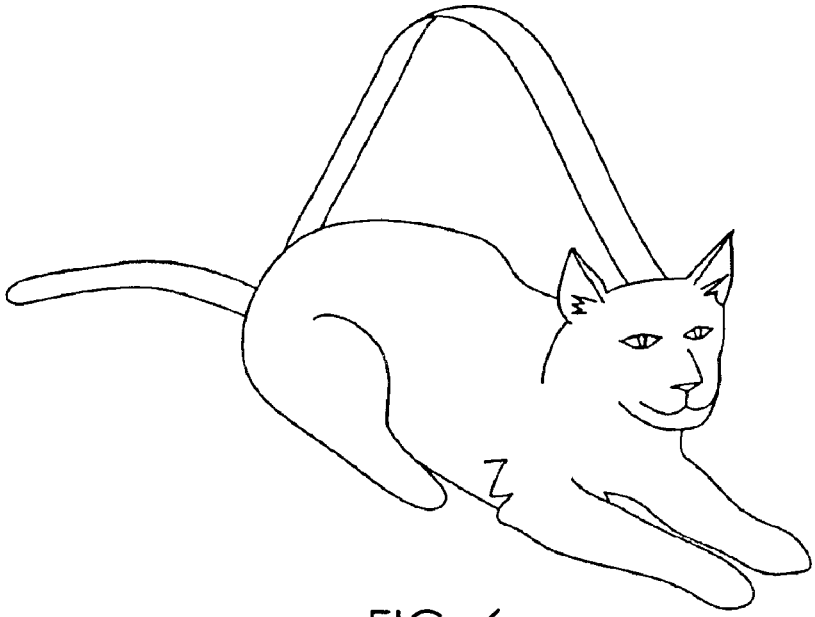
FIG. 6 illustrates an embodiment of the sleeping means in one embodiment of a storage condition.
Figure 7:
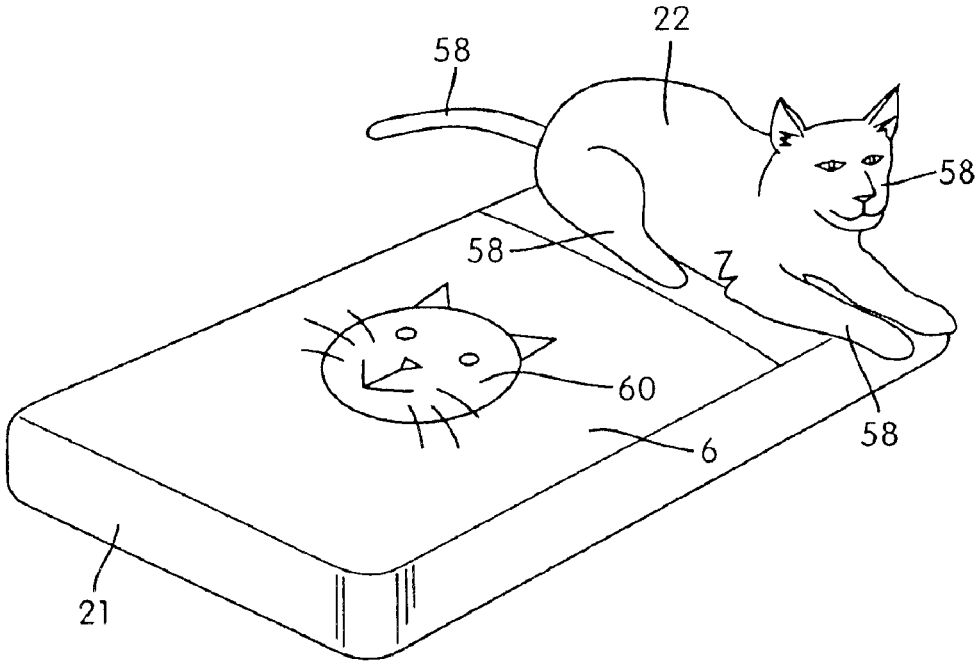
FIG. 7 illustrates the sleeping means of FIG. 6 in an in-use condition.

An example of this is illustrated in FIGS. 6 and 7 where it is shown how elements 58 are added to the pillow receiving portion 22 to represent a cat and a printed or otherwise applied image 60 on the cover 6 of the sleeping means interacts with these additional 3D elements to further improve the attractiveness of the sleeping means, especially to children.

The storage of the sleeping means when in a deflated condition is also important in that for the sleeping means to be attractive for purchase it is important that the same can be stored easily and compactly. FIGS. 6 and 7 illustrate a first method of storage wherein the soft plush 3 dimensional pillow receiving portion 22 is also usable as a storage bag as shown in FIG. 6. To move from the in use position of FIG. 7 to the storage condition of FIG. 6 the deflated mattress and sheet material are rolled from the foot end 21 to the pillow end. The pillow receiving portion 22 has an opening, not shown, through which the rolled up sleeping means is inserted into the pillow receiving portion. Typically the opening has a zip and the provision of a shoulder strap allows the same to be easily transportable. To move the same to an in use position the opening is unzipped and the entire mattress with sheet material then rolled out and inflated in the normal way. The empty pillow receiving portion can then be filled with a standard pillow or by the inflation of a suitably formed portion 27 of the mattress, and the resulting soft shape can then become a 3D pillow at the end of the bed as shown in FIG. 7.

Figure 8A:
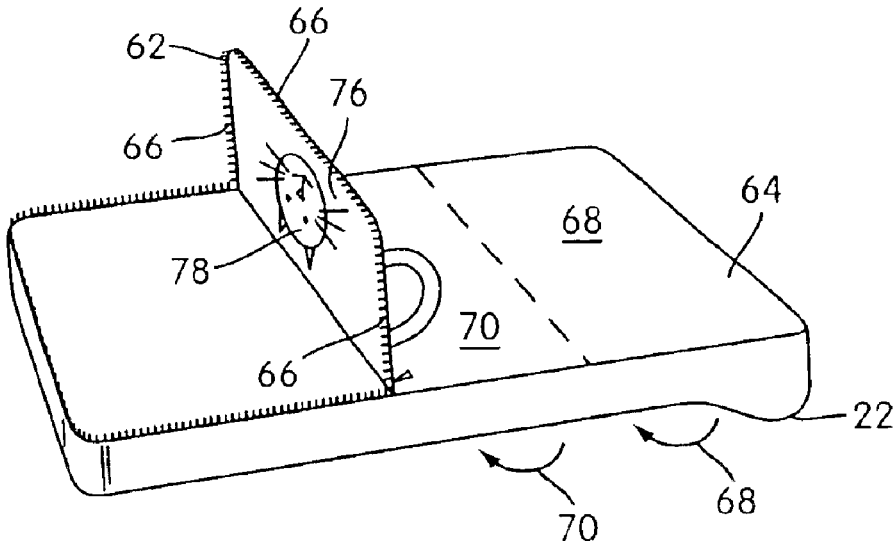
Figure 8B:
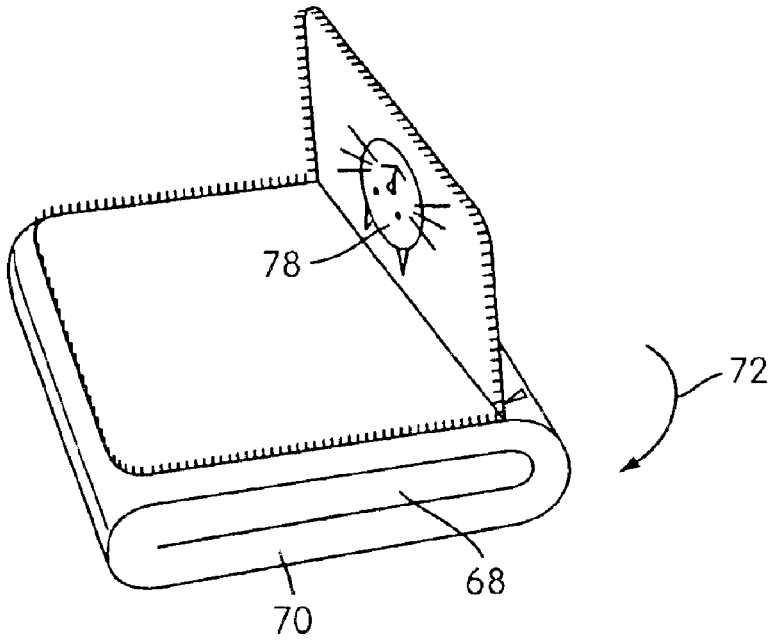

In an alternative embodiment as shown in FIGS. 8A–E it is possible to store the sleeping means by providing an additional portion of sheet material 62 to the underside or base 64 of the sleeping means. The additional portion 62 has a zip or other selective fastening means 66 with a zip on 3 sides that can selectively be used to secure the portion 62 back to the base 64 as is shown. In FIG. 8A the sleeping means is shown in an in use condition with the same upside down and the base 64 uppermost and with the mattress deflated. With the selective engagement means 66 released, the mattress and sheet material are folded towards the additional portion 62 in sections as indicated by 68,70 in FIGS. 8A and B.

Figure 8C:
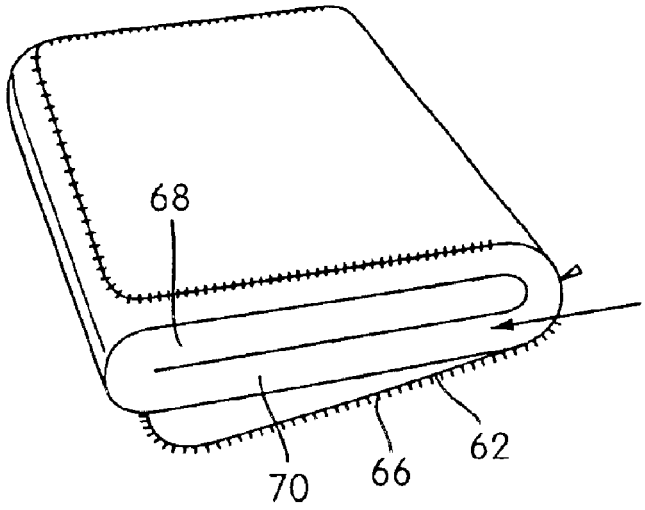
Figure 8D:
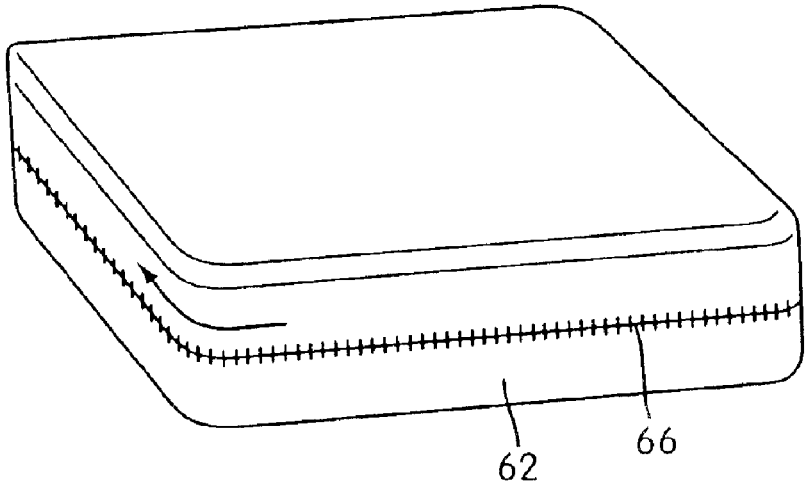
Figure 8E:
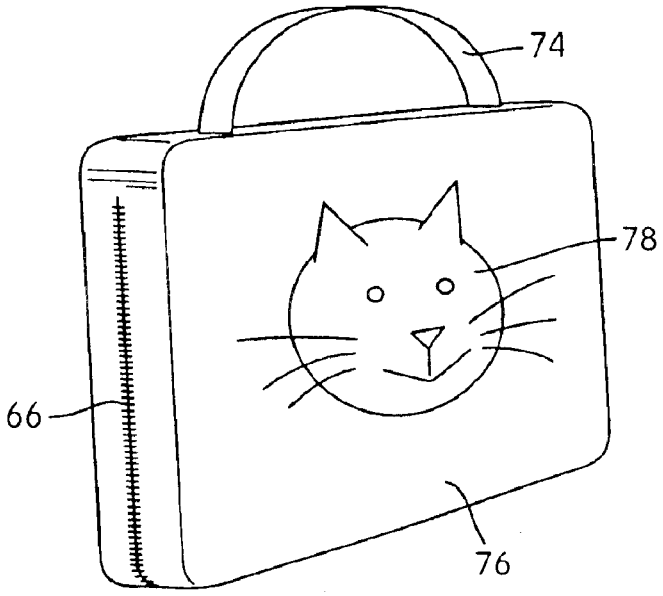

When in this condition the additional portion is folded around the sheet material and mattress portions 68,70 as indicated by arrow 72 to reach the position shown in FIG. 8C, In this position, the zip 66 can be fastened and so the storage bag formed as shown in FIGS. 8D and E. A handle 74 can be provided. In order to add to the attractiveness of the storage bag the surface 76 of the additional portion can have images 78 formed thereon as when the bag is formed as shown in FIG. 8F this surface 76 forms an external surface of the bag.

The advantage of this embodiment is that an effective storage bag with a minimal amount of additional material is achieved as the back of the bad becomes part of the bag.

FIG. 9 illustrates a further embodiment of the invention where the sleeping means includes, in addition to the mattress and sheet material, an enclosure 80. The enclosure can be formed from a frame such as an inflatable frame or, as shown, a frame formed from a series of resilient members 82. The enclosure can be provided as a novelty feature for children or, in warm climate, 4, it is advantageous to enclose the sleeping area with some sort of mesh envelope 84 so as to exclude mosquitoes or other insects. With this embodiment of the invention, it is possible to build in a closed hood system that excludes insects from the area around the pillow. This hood system can be simply constructed using fiberglass rods, or by using a combination of fiberglass and spring steel so that the frame is biased to an erected enclosure condition when the sleeping means is moved from the storage condition.

What is claimed is:

1. A sleeping structure comprising:

a sheet material envelope having an opening into a cavity defined therein;

a deformable mattress received and substantially enclosed within the cavity of the sheet material envelope; and a cover portion which, in conjunction with the ton surface of the envelope, defines a sleeping a area in which a person can lie and be supported by the mattress, the cover portion is being movable between a first position to substantially enclose the person within the sleeping area and a second position to allow the person to get into or out of the sleeping area of the sleeping structure, wherein the mattress is inflatable between an inflated in-use condition and a deflated storage condition, the mattress including a pillow portion which is inflatable as part of the mattress and the sheet material envelope having formed therein a pillow receiving portion for the acceptance of the pillow portion of the mattress, wherein an inflatable surround is provided around at least a portion of the sheet material envelope.

2. A sleeping structure comprising:

a sheet material envelope having an opening into a cavity defined therein;

a deformable mattress received and substantially enclosed within the cavity of the sheet material envelope; and a cover portion which, in conjunction with the top surface of the envelope, defines a sleeping area in which a person can lie and be supported by the mattress, the cover portion is being movable between a first position to substantially enclose the person within the sleeping area and a second position to allow the person to get into or out of the sleeping area of the sleeping structure, wherein the mattress is inflatable between an inflated in-use condition and a deflated storage condition, the mattress including a pillow portion which is inflatable as part of the mattress and the sheet material envelope having formed therein a pillow receiving portion for the acceptance of the pillow portion of the mattress, wherein an inflatable surround is provided around at least a portion of the sheet material envelope, and wherein the inflatable surround is connectable to the mattress to allow inflation of the surround and mattress via a single inlet valve.

3. A sleeping structure comprising:

a sheet material envelope having an opening into a cavity defined therein;

a deformable mattress received and substantially enclosed within the cavity of the sheet material envelope;

a cover portion which, in conjunction with the toy surface of the envelope, defines a sleeping area in which a person can lie and be supported by the mattress, the cover portion is being movable between a first position to substantially enclose the person within the sleeping area and a second position to allow the person to get into or out of the sleeping area of the sleeping structure, wherein the mattress is inflatable between an inflated in-use condition and a deflated storage condition, the mattress, including a pillow portion which is inflatable as part of the mattress and the sheet material envelope having formed therein a pillow receiving portion for the acceptance of the pillow portion of the mattress; and an enclosure structure over at least a portion of the sleeping structure wherein the enclosure structure incorporates a frame over which sheet material is placed to form the enclosure structure, the frame being formed of at least one resilient member which is biased towards an erected condition for the enclosure structure, and wherein the said at least one resilient member is stored in a coiled condition and, when released, moves to an erected condition whereupon the same can be attached to the sleeping structure.

4. A sleeping structure comprising:

a sheet material envelope having an opening into a cavity defined therein;

an inflatable mattress constructed to be received and substantially enclosed within the cavity of the sheet material envelope; and a cover portion which, in conjunction with a top surface of the sheet material envelope, defines a sleeping area in which a person can lie and be supported by the mattress, the cover portion being movable between and first position to substantially enclose the person within the sleeping area and a second position to allow the person to get into or out of the sleeping area, the top surface of the envelope and the cover portion each including a filling material to insulate the sleeping area, wherein one side edge and a foot end edge of the cover portion is attached to the envelope sheet material and an opposing side edge, opposite the one side edge, is selectively and releasably attached to envelope sheet material by a zipper to retain the cover portion in the first position, wherein the mattress includes a series of side by side inflatable sections that extend longitudinally along the mattress, the mattress being inflatable between an inflated in use condition and a deflated storage condition, the side by side inflatable sections being interconnected to allow the passage of air for inflation and deflation via a single valve, the valve having a diameter greater than 15 mm, wherein the sheet material envelope has a pillow receiving portion for the acceptance of a pillow portion provided by a pillow material, wherein the cover portion includes an image thereon comprising a character, animal or shape, and wherein the pillow receiving portion is provided with at least one three-dimensional element attached thereto to depict a character, animal or shape that is associated with the character, animal or shape depicted by the cover portion.

5. A sleeping structure according to claim 4, wherein said one side edge and said foot edge are interconnected through a peripheral strip of material.

* * * * *